United States Patent [19]

Eppenbach

[11] Patent Number: 4,858,635

[45] Date of Patent: Aug. 22, 1989

[54] TENT

[76] Inventor: Lawrence C. Eppenbach, 900 First Ave. South, Seattle, Wash. 98134

[21] Appl. No.: 158,591

[22] Filed: Feb. 22, 1988

[51] Int. Cl.[4] ..... A45F 1/16

[52] U.S. Cl. ..... 135/104; 135/105; 135/117

[58] Field of Search ..... 135/104, 117, 105, 115, 135/116, 102, 901

[56] References Cited

U.S. PATENT DOCUMENTS

| | | | |
|---|---|---|---|
| 941,765 | 11/1909 | Davidson | 135/117 |
| 3,182,672 | 5/1965 | Biller | 135/117 |
| 4,067,346 | 1/1978 | Husted | 135/901 X |
| 4,236,543 | 12/1980 | Moss | 135/104 X |
| 4,709,718 | 12/1987 | Nichols | 135/104 X |
| 4,751,936 | 6/1988 | Zibble | 135/117 |

OTHER PUBLICATIONS

Duckman Intruder Field Blind, p. 129 of an Order Catalogue.

The Pop-Up Brand Blinds, Ford Dixon Company, Dallas, Texas.

*Primary Examiner*—Henry E. Raduazo

*Assistant Examiner*—Lan Mai

*Attorney, Agent, or Firm*—Gordon L. Peterson

[57] ABSTRACT

A tent comprising a frame, sheet material on the frame formed into an enclosure having a base and a ceiling with an opening in the ceiling and an elongated pivot member having opposite ends and mounted for pivotal movement over the opening. A flexible flap is coupled to the sheet material and to the pivot member so that the pivot member can pivot to cause the flap to open and at least partially close the opening. A rain fly of flexible sheet material is adapted to overlie the opening and be supported by the pivot member above the opening to thereby close the opening and increase the vertical space available in the tent.

18 Claims, 2 Drawing Sheets

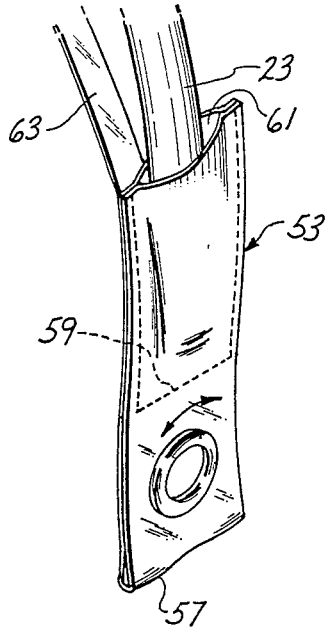
FIG. 3
FIG. 5
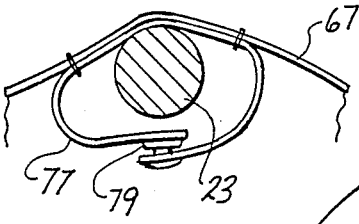
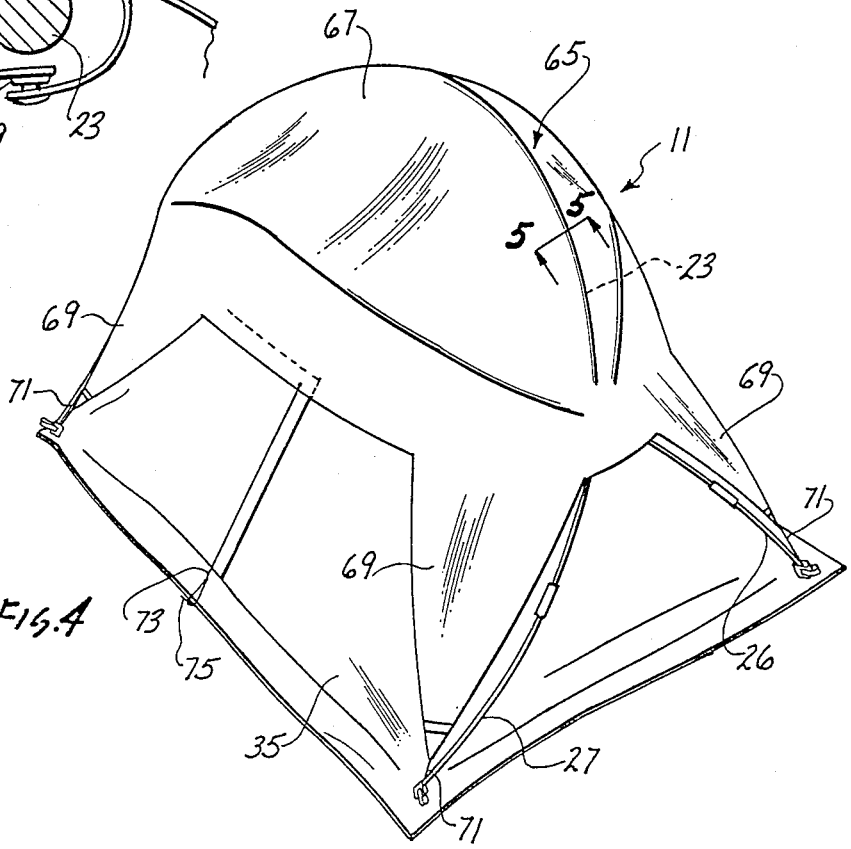
FIG. 4

TENT

BACKGROUND OF THE INVENTION

A hunting blind is used to conceal the hunter from game and to provide some protection from the elements. Hunting blinds come in various different styles and configurations and may be in the form of a tent-like structure. To enable the hunter to shoot, the blind typically has an opening in the ceiling or roof which can be closed to conceal the hunter and which can be opened to enable the hunter to shoot at game.

As the game approaches, it is often necessary for the hunter to rapidly open the opening in the blind. This may have to be done under conditions where the hunter is nervous or under stress in anticipation of the approaching game. Accordingly, it is necessary that the opening be quickly and easily opened under these conditions.

It is known to utilize a flap to close the opening and to couple the flap to a hinged structure to facilitate removal of the flap to expose the opening. However, these prior hinged structures are more complex and less compact than is desired.

It is also desirable to be able to convert a hunting blind to other purposes, such as an observation tent or a tent for general camping purposes. The typical hunting blind cannot be simply converted to a tent for these other purposes.

SUMMARY OF THE INVENTION

This invention provides a tent which can be readily adapted to serve a variety of purposes, including hunting, observation and camping. The tent can be quickly and easily converted from one purpose top another, and only a minimum of components is required. Moreover, when the tent is taken down, it is very compact.

A tent constructed in accordance with this invention may include a frame, sheet material on the frame formed into an enclosure having a peripheral wall and a ceiling with an opening in the ceiling, and an elongated pivot member having opposite ends mounted for pivotal movement over the opening. A flexible flap for opening and at least partially closing the opening has a first region coupled to the sheet material and is attached at a second region to the pivot member. With this construction, the pivot member can pivot to cause the flap to open and at least partially close the opening.

One feature of this invention is that the pivot member is bowed. This enables the pivot member to be in the form of a simple tent pole which can be easily disassembled and compactly stored along with the other components of the tent. Accordingly, the pivot member is of exceedingly simple structure and adds virtually no bulk to the disassembled tent.

Another important advantage of the bowed pivot member is that it can be used to support a rain fly of flexible sheet material. By installing the rain fly, the tent is adapted for general camping purposes. The rain fly overlies the opening and is supported by the pivot member above the opening to thereby enclose the opening and increase the headroom in the tent. The bowed configuration of the pivot member assists in giving the rain fly a sloping configuration which is well suited to shedding water, and because the blowed pivot member may extend well above the opening, the headroom in the tent is materially increased. Thus, the bowed pivot member performs important functions in both the hunting and camping modes of the tent.

Although the pivot member may be present in a bowed configuration, preferably, the pivot member is resilient and is deflected by the mounting means for the pivot member into a bowed configuration. Preferably, the pivot member is straight in the unstressed condition so that it can be more compactly stored.

To restrain the second region of the flap from moving along the pivot member, the tent may include elongated, flexible tensioning means coupled to the flap. The tensioning means preferably includes first and second elongated flexible tensioning members coupled to the second region of the flap and to the flexible sheet material on opposite sides of the opening.

The tent may also be used for observation, such as bird watching. If this feature is provided, the sheet material includes a transparent section, such as transparent plastic or netting, extending substantially around the tent adjacent the ceiling. Although the pivot member can be mounted for pivotal movement in various different ways, the mounting means may advantageously include first and second pockets separated by the opening, with the pockets receiving the ends, respectively, of the pivot member and being pivotally attached to the sheet material.

This invention is applicable to tents of various different styles and configurations. However, the ceiling or top of the tent is preferably broad or dome-shaped rather than coming to a point as is the case with a triangular tent. A preferred form of tent is a luna-style tent in which the frame members are crossed, and the ceiling is elongated and sloped. With a luna-style tent, the pivot member can advantageously extend over the ceiling generally in the direction of elongation of the ceiling and be pivotally mounted adjacent the opposite ends of the ceiling.

With a luna-style tent, the ceiling and peripheral wall of the tent are held in tension by first and second crossed frame members which extend, respectively, between the corners at opposite longitudinal ends of the tent. The opening in the ceiling of the luna-style tent extends longitudinally for substantially less than the full longitudinal length of the ceiling, and the opening is longitudinally between sections of sheet material of the ceiling. These sections of sheet material of the ceiling are tensioned by the frame members. If the opening extended for the full longitudinal length of the ceiling, it would be necessary to provide additional frame members to prevent the tent from collapsing. Accordingly, another feature of this invention is the provision of an opening in the ceiling of a luna-style tent in a way that does not require additional frame members to prevent the tent from collapsing.

The invention, together with additional features and advantages thereof, may best be undersetood by reference to the following description taken in connection with the accompanying illustrative drawing.

BRIEF DESCRIPTION OF THE DRAWING

FIG. 3 is a fragmentary, perspective view illustrating one preferred technique for pivotally mounting the pivot member.

FIG. 4 is a perspective view similar to FIG. 1, with a rain fly installed.

FIG. 5 is an enlarged, fragmentary, sectional view taken generally along line 5—5 of FIG. 4.

DESCRIPTION OF THE PREFERRED EMBODIMENT

Figure 1:
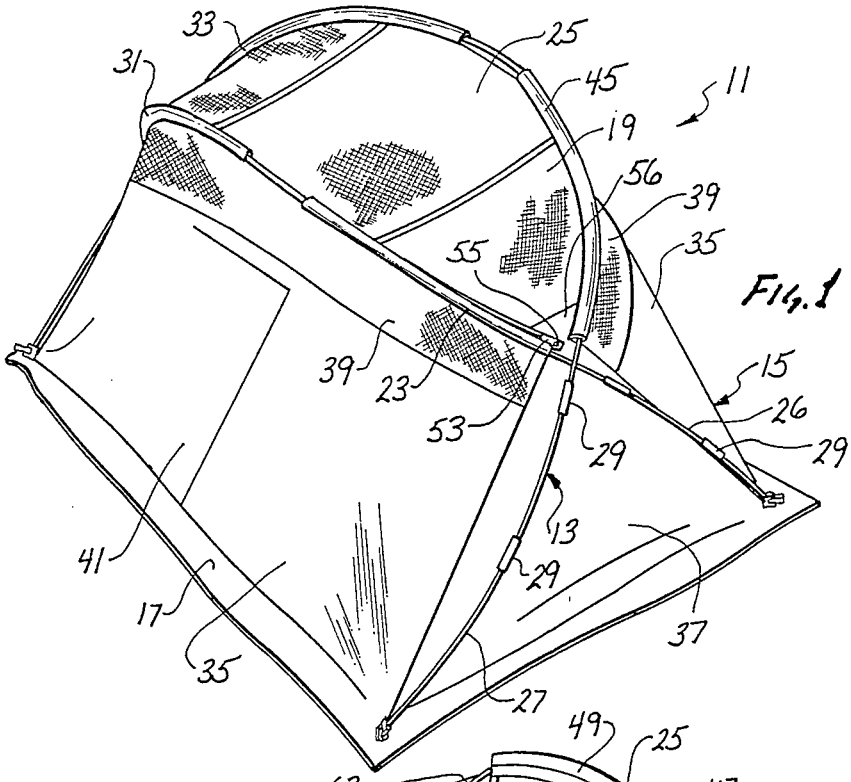
FIG. 1 is a perspective view of a tent constructed in accordance with the teachings of this invention, with the door and flap closed.

FIG. 1 shows a luna-style tent 11 which comprises a frame 13, sheet material 15 on the frame formed into an enclosure having a base 17 and a ceiling or roof 19 with an opening 21 (FIG. 2) in the ceiling. The tent 11 also includes an elongated, bowed pivot member 23 mounted for movement over the opening 21 and a flexible flap 25 for opening and at least partially closing the opening 21.

More specifically, the frame 13 includes frame members 26 and 27 which are crossed at the opposite ends of the tent to form a luna-style tent configuration. Each of the frame members 26 and 27 is conventional and may include a plurality of flexible sections joined together in end-to-end relationship by couplings 29 in a known manner. The frame members 26 and 27 extend through sleeves 31 and 33, respectively, of the sheet material 15 in a known manner to support and tension the sheet material. When so supported, the sheet material 15 forms a peripheral wall which includes opposite side walls 35 and opposite identical end walls 37 (only on being illustrated) in addition to the ceiling 19.

Figure 2:
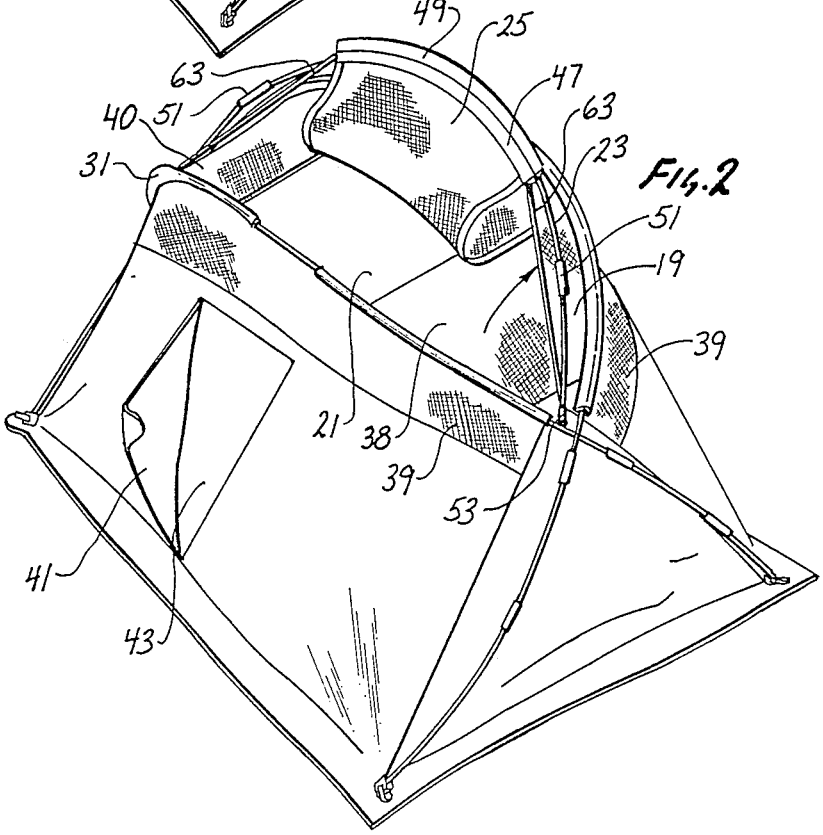
FIG. 2 is a pespective view similar to FIG. 1 with the flap and door partially open.

The ceiling 19 is elongated between the end walls 37 and slopes downwardly and narrows toward each of the end walls. In this embodiment, the opening 21 is centered in the ceiling 19 and is positioned longitudinally between sections 38 and 40 of sheet material of the ceiling. The sections 38 and 40, as well as the peripheral wall of the tent 11, are tensioned by the frame members 26 and 27. The tension across the sections 38 and 40 maintains the tent 11 in an upright position. This tension also extends to the side walls 35 to materially improve the structural rigidity of the tent 11. As shown in FIG. 2, the opening 21 extends longitudinally for substantially less than the full longitudinal length of the ceiling 19 and extends transversely completely across the ceiling from the sleeves 31 to the sleeves 33. Although a luna-style tent having a ceiling 19 as shown and described is preferred, in a broader sense, the ceiling is merely the upper region or top of the tent and can be of various different configurations providing it maintains tension across a significant part of the ceiling.

The sheet material 15 is flexible and can be of various different materials. In the illustrated embodiment, the sheet material 15 includes transparent material in the form of bands 39 of netting extending along an upper section of the full length of each of the side walls 35. In addition, the ceiling 19 preferably is constructed almost entirely of netting, which is also transparent. The bands 39 extend substantially around the tent adjacent the ceiling 19, and these bands, particularly when considered in conjunction with the netting of the ceiling 19, provide essentially a 360 degree field of view for an observer within the tent 11. The remainder of the sheet material 15 including the sheet material below the bands 39 and the sheet material making up the end walls 37 is constructed of a suitable waterproof material, such as canvas, which is preferably opaque. To provide access to the interior of the tent 11, the material of one of the side walls 35 is cut to form a door 41 which can be opened to provide a side opening 43 (FIG. 2) into the tent 11.

The flap 25 is also preferably constructed of a transparent material, such as netting to enhance overhead viewing by an observer or hunter within the tent 11. The flap 25 has a first region which is sewed to the sheet material 15 along a seam 45 (FIG. 1) at the juncture of the ceiling 19 and one of the side walls 35 and a second region formed into a loop 47 (FIG. 2) which constitutes means for attaching this region of the flap to the pivot member 23. During assembly, the pivot member 23 is extended completely through the loop 47. The flap 25 is preferably provided with an extension 49 of material which engages the sleeve 31 in the closed position of the flap to help seal that end of the flap when the flap is closed.

The flap 25 can be moved between a completely closed position shown in FIG. 1 in which the flap overlies the opening 21 and overlaps the edges of the opening and an open position in FIG. 2 in which at least a portion of the flap is pulled back away from the opening to expose the opening. Some material of the flap 25 may overlie the opening 21 in the open position, but this material can be readily pushed aside by the hunter or observer, if desired.

The pivot member 23 may be very similar to the frame members 26 and 27 in that it may include a plurality of individual resilient sections joined together in end-to-end relationship by couplings 51. For example, each of these sections may be constructed of figerglass.

In the unstressed condition, the pivot member 23 is straight and linear, but it is resilient and can be deflected by its mounting means into a curved or bowed configuration along essentially its full length. Although the mounting means for the pivot member 23 can take different forms, it preferably includes identical pockets 53 (only one being shown in FIGS. 1 and 3), pivotally attached by a rivet 55 to a web 56 of sheet material at the end of the ceiling 19. Alternatively, the pockets 53 can be attached to the web 56 by stitching, in which event, the pockets would allow pivotal motion of the pivot member 23 without the pockets pivoting with respect to the webs 56. One end of the pivot member 23 is received in each of the pockets 53 as shown in FIGS. 1 and 3. Although various constructions are possible, in this embodiment, each of the pockets 53 is formed by folding an elongated strip of material along a fold line 57 (FIG. 3) and stitching the material along a line 59 to form a blind recess 61 into which an end of the pivot member 23 is received. With the pivot member 23 received within the pockets 53 in this manner, it is resiliently deflected to induce an arc or a bow into the pivot member as shown in FIGS. 1 and 2.

Elongated flexible tensioning members 63, such as cords or straps, are coupled at one end to the webs 56, respectively, and at the other end to the adjacent end of the flap 25. This restrains the flap 25 along the loop 47 from moving along the pivot member 23. The tensioning members 63 may also be of assistance in deflecting the pivot member 23.

As shown in FIGS. 1 and 2, the tent 11 is adapted for use in either the hunting or observation mode. For example, in the observation mode, one or more observers may sit within the tent 11 and observe wildlife, such as birds, through the bands 39 and the ceiling 19. In the hunting mode, the hunter sits within the tent 11 with the opening 21 closed by the flap 25 as shown in FIG. 1. As game approaches, the hunter opens the opening 21 by pivoting the pivot member 23 from the closed position of FIG. 1 to the open position of FIG. 2. Thus, in a simple pivoting motion of the pivot member 23, the opening 21 is opened. Of course, the sheet material 15 may be colored or have a camouflaged appearance to reduce the likelihood that it will be identified as a man made object when in use.

FIG. 4 shows one way in which the tent 11 can be used in a camping mode. In FIG. 4, the tent 11 includes a rain fly 65 of canvas or other water-repellant material. The rain fly 65 includes a main body 67 configured to cover the bands 39 and the ceiling 19 of the tent and four legs 69 (only three being shown in FIG. 4) extending downwardly from the main body 67 along the four corners, respectively, of the tent 11. Various different means can be used to tension the rain fly 65 on the tent structure beneath it. In this embodiment, such means includes each of the legs 69 being tied to the bottom of the adjacent frame member 26 and 27 by a resilient cord 71. In addition, the rain fly 65 may be anchored to the ground intermediate the legs 69 by cords 73 coupled to the main body 67 on opposite sides of the tent 11 and looped around a stake 75.

To support the rain fly 65, the pivot member 23 is pivoted to the vertical or 12 o'clock position and then the rain fly 65 is installed. The rain fly 65, which is flexible, overlies the opening 21 and is supported by the pivot member 23 and by portions of the frame members 26 and 27 above the opening 21 to close the opening. The rain fly 65 is preferably releasably attached to the pivot member 23, such as by one or more loops 77 which are attached to the rain fly and which can be closed around the pivot member by snap fasteners 79. The loops 77 may be, for example, on opposite sides of the flap 25. The vertical positioning of the bowed pivot member 23 supports the main body 67 of the rain fly 65 well above the opening 21 to thereby increase the headroom in the tent 11 and to provide a good slope to the main body 67 so the tent will properly shed water. The rain fly 65 comes far enough down the side walls 35 to completely cover the bands 39, and the flexibility of the sheet material of the rain fly allows it to conform to the shape of the tent structure beneath it.

Although an exemplary embodiment of the invention has been shown and described, many changes, modifications and substitutions may be made by one having ordinary skill in the art without necessarily departing from the spirit and scope of this invention.

I claim:

1. A tent comprising;

a frame including crossed frame members;

sheet material supported by the frame and formed into an enclosure having a peripheral wall and an elongated sloped ceiling with an opening in the ceiling, said opening extending longitudinally for substantially less than the full longitudinal length of the ceiling;

an elongated, bowed pivot member having opposite ends, said pivot member extending over the ceiling generally in the direction of elongation of the ceiling;

means for mounting the pivot member for pivotal movement over the opening;

a flexible flap for opening and at least partially closing the opening, a first region of said flap being coupled to the sheet material; and means for attaching a second region of the flap to the pivot member whereby the pivot member can pivot to move the flap transversely to the direction of elongation of the ceiling to open and at least partially close the opening.

2. A tent as defined in claim 1 including an elongated flexible tensioning means coupled to the flap for restraining the second region of the flap from moving along the pivot member.

3. A tent as defined in claim 1 including first and second elongated flexible tensioning members coupled to said second region of the flap and to the flexible sheet material on opposite sides of the opening.

4. A tent as defined in claim 1 wherein said pivot member is resilient and is deflected by the mounting means to bow the pivot member.

5. A tent as defined in claim 1 wherein the mounting means includes a pocket for receiving one of the ends of the pivot member and the pocket is pivotally attached to the sheet material.

6. A tent as defined in claim 1 wherein the mounting means includes first and second pockets separated by said opening, said pockets releasably receive said ends, respectively, of the pivot member and are pivotally attached to the sheet material and the pivot member is resilient and is deflected into a bowed configuration by the pockets.

7. A tent as defined in claim 1 wherein said sheet material includes a transparent section in the peripheral wall extending substantially around the tent adjacent the ceiling.

8. A tent as defined in claim 1 including a rain fly of flexible sheet material adapted to overlie said opening and be supported by the pivot member above the opening to thereby close the opening and increase the headroom in the tent above the crossed frame members.

9. A tent as defined in claim 8 including means releasably attaching the rain fly to the pivot member.

10. A tent as defined in claim 6 including first and second elongated flexible tensioning members coupled to said second region of the flap and to the flexible sheet material on opposite sides of the opening, said sheet material includes a transparent section extending substantially around the tent adjacent the ceiling.

11. A tent as defined in claim 1 wherein the mounting means includes first and second pockets separated by said opening, said pockets receive said ends, respectively, of the pivot member and are pivotally attached to the sheet material adjacent the opposite ends of the ceiling.

12. A tent comprising:

a frame including crossed frame members;

sheet material supported by the frame and formed into an enclosure having a peripheral wall and an elongated sloped ceiling with an opening in the ceiling, said opening extending longitudinally for substantially less than the full longitudinal length of the ceiling;

an elongated pivot member having opposite ends, said pivot member extending over the ceiling generally in the direction of elongation of the ceiling;

means for mounting the pivot member for pivotal movement over the opening; and a rain fly of flexible sheet material adapted to overlie said opening and be supported by the pivot member above gthe opening to thereby close the opening and increase the headroom in the tent above the crossed frame members.

13. A tent as defined in claim 12 including means for tensioning the rain fly over the pivot member.

14. A tent as defined in claim 12 wherein said pivot member is resilient and is deflected by the mounting means into a bowed configuration.

15. A tent as defined in claim 12 wherein the mounting means includes a pocket for receiving one of the ends of the pivot member and the pocket is pivotally attached to the sheet material.

16. A tent as defined in claim 12 wherein the mounting means includes first and second pockets separated by said opening, said pockets receive said ends, respectively, of the pivot member and are pivotally attached to the sheet material and the pivot member is resilient and is deflected into a bowed configuration by the pockets.

17. A tent as defined in claim 12 wherein the mounting means includes first and second pockets separated by said opening, said pockets receive said ends, respectively, of the pivot member and are pivotally attached to the sheet material adjacent the opposite ends of the ceiling.

18. In a luna-style tent having a frame including first and second crossed frame members extending between corners of the tent, sheet material supported by the frame formed into an enclosure having a peripheral wall and an elongated, sloped ceiling with the first and second frame members tensioning the sheet material of the ceiling and of the peripheral wall, the improvement comprising:

the ceiling having a central opening therein which extends longitudinally for substantially less than the full longitudinal length of the ceiling and with the opening being longitudinally between sections of sheet material of the ceiling, said sections of the sheet material narrowing as they extend away from each other and being tensioned by the first and second frame members, said opening having edges extending transversely of the ceiling with at least portions of said edges being straight.

* * * * *